US007464643B2

(12) United States Patent
Pointl

(10) Patent No.: US 7,464,643 B2
(45) Date of Patent: Dec. 16, 2008

(54) SELF-INKING HAND STAMP

(75) Inventor: Hartwig Pointl, Scharnstein (AT)

(73) Assignee: Colop Stempelerzeugung Skopek Gesellschaft m.b.H. & Co. KG, Wels (AT)

( * ) Notice: Subject to any disclaimer, the term of this patent is extended or adjusted under 35 U.S.C. 154(b) by 448 days.

(21) Appl. No.: 10/574,628

(22) PCT Filed: Sep. 30, 2004

(86) PCT No.: PCT/AT2004/000330

§ 371 (c)(1),
(2), (4) Date: Apr. 5, 2006

(87) PCT Pub. No.: WO2005/037565

PCT Pub. Date: Apr. 28, 2005

(65) Prior Publication Data

US 2007/0012206 A1 Jan. 18, 2007

(30) Foreign Application Priority Data

Oct. 17, 2003 (AT) ..... A 1647/2003

(51) Int. Cl.
*B41K 1/56* (2006.01)

(52) U.S. Cl. ..... 101/405; 101/333; 101/334

(58) Field of Classification Search ..... 101/103, 101/104, 327, 333, 334, 405, 406
See application file for complete search history.

(56) References Cited

U.S. PATENT DOCUMENTS 5,058,501 A 10/1991 Skopek (Continued)

FOREIGN PATENT DOCUMENTS

AT 5 826 12/2002

(Continued)

*Primary Examiner*—Daniel J. Colilla
*Assistant Examiner*—David Banh
(74) *Attorney, Agent, or Firm*—Collard & Roe, P.C.

(57) ABSTRACT

The invention relates to a self-inking hand stamp (1) comprising a housing (2) and an actuating arc (3) that can be displaced in relation to the housing and in which a stamp type part with axial parts (10, 11) is mounted, said axial parts protruding through slit-type openings (25) in lateral walls (8, 9) of the housing (2). At least one of said axial parts is held in a recess (26, 27) in one of the lateral parts (12, 13) of the actuating arc (3) by means of a separately produced fixing element. The fixing element can be introduced into the recess (26, 27), and locked therein, in such a way that the axis thereof is parallel to the axis of the recess, said fixing element comprising at least one locking element (29, 30; 35) that cooperates with a corresponding locking element (31; 37, 38) on the lateral side (12, 13) of the actuating arc (3). The inventive stamp is also provided with a turning mechanism (7) for the stamp plate (6), for displacing the stamp plate from an upper inking position against an inking cushion (51), to a lower stamp position, during the displacement of the actuating arc (3) in relation to the housing (2). The fixing element is formed by at least one bearing part (14, 15) comprising a cylindrical bearing recess (28) for the axial part (10, 11) of a stamp plate (6) provided as a stamp type part, said bearing part having a plurality of locking positions in the lateral side (12, 13) of the actuating arc (3) in the axial direction.

17 Claims, 12 Drawing Sheets

U.S. PATENT DOCUMENTS

| | | | |
|---|---|---|---|
| 5,152,223 | A | 10/1992 | Mairon |
| 5,727,467 | A | 3/1998 | Skopek |
| 6,067,905 | A | 5/2000 | Faber |
| 6,453,813 | B1 | 9/2002 | Faber |

FOREIGN PATENT DOCUMENTS

| | | |
|---|---|---|
| DE | 19 06 426 | 11/1969 |
| DE | 202 05 193 | 8/2002 |
| WO | WO 99/16624 | 4/1999 |
| WO | WO 2004/060685 | 7/2004 |

SELF-INKING HAND STAMP

CROSS REFERENCE TO RELATED APPLICATIONS

Applicant claims priority under 35 U.S.C. §119 of Application No. A 1647/2003 filed Oct. 17, 2003. Applicant also claims priority under 35 U.S.C. §365 of PCT/AT2004/000330 filed Sep. 30, 2004. The international application under PCT article 21(2) was not published in English.

BACKGROUND INFORMATION

The invention relates to a self-inking hand stamp of claim 1.

From U.S. Pat. No. 5,152,223 A, e.g., a self-inking hand stamp is known in which the lateral parts of an actuator yoke on their inner side have integrally molded bearing blocks guided in slit-type openings in the side walls of the housing, and in which lateral parts there are provided cylindrical bearing recesses which house and rotatably accommodate pin-shaped axle portions integrally molded with the stamp plate of the hand stamp. These axle portions thus define the turning axis of the stamp plate about which the stamp plate is turned by 180° during actuation of the hand stamp, when the actuator yoke is pressed downwards relative to the housing. What is disadvantageous there is that during mounting, the lateral parts of the actuator yoke must be moved apart under elastic deformation until the stamp plate engages with its axle portions in the cylindrical bearing recesses. By this, the material of the actuator yoke is subjected to wear, so that a corresponding elastic, yet solid synthetic material must be chosen, wherein it may happen nevertheless that the lateral parts of the actuator yoke will break during mounting or dismounting of the stamp plate. Here, it is a further disadvantage that the actuator yoke must be locked relative to the housing by insertion of locking parts through openings above the ink pad, e.g. for withdrawing the ink pad from its associated insertion compartment and refilling of stamping ink. This type of locking additionally complicates handling of that hand stamp.

A simpler form of locking the actuator yoke on the housing of the hand stamp in various positions is disclosed in U.S. Pat. No. 5,727,467 A: In the hand stamp known from this publication, resilient snap-in tongues comprising latching hooks are provided on the lateral parts of the actuator yoke, which can be latched in or hooked in corresponding latching recesses on the side walls of the housing of the hand stamp by pushing the former inwards. On the stamp housing, two latching recesses are provided one above the other, thereby defining two locking positions, i.e. an upper one for withdrawing or inserting the ink pad, and a lower one, in which the hand stamp has its smallest vertical dimension and in which the stamp plate with its printing characters is oriented downwards so that, in this position, also printing characters may be exchanged if the stamp plate or the stamp unit is appropriately designed. Yet, also here it holds that essential parts of the lateral parts of the actuator yoke are elastically deformed during locking, resulting in great material wear over extended periods of time, which may lead to fatigue symptoms and which can be counteracted only by appropriately choosing a synthetic material of high quality. It would, however, be desirable to be able to use also less expensive synthetic materials.

Furthermore, from DE 19 06 426 B (and, similarly, from U.S. Pat. No. 5,058,501 A), self-inking stamps are known in which a respective turning or control axle passes through the respective stamp unit, and with each end region thereof passes through a control slit in the stamp housing, wherein the end region of the axle is mounted in the associated lateral part of the actuator yoke by means of a slipped-on bearing bushing part, and is axially secured by means of a safety part formed, e.g., by an outer annular flange on the bearing bushing part.

These stamp constructions involve comparatively much effort during their production as well as, in particular, when assembling the individual stamp parts.

From U.S. Pat. No. 6,067,905 A, or from the corresponding WO 99/16624, respectively, a structure of a hand stamp of the same type as the present hand stamp is known, in which a separate inverting axle passes through a stamp plate, this inverting axle being mounted in the ends of the lateral parts of the actuator yoke and secured there by means of separate safety elements each. For this purpose, the inverting axle includes peripheral grooves at its ends which cooperate with corresponding bearing projections in bearing seats of the lateral parts of the actuator yoke, and the separate safety elements press the inverting axle to these bearing projections. The main function of these safety elements is to secure, by their secure mounting on the respective lateral part of the actuator yoke, the inverting axle in axial direction so that the inverting axle cannot unintentionally move in axial direction or even inadvertently fall out of the stamp unit.

SUMMARY OF INVENTION

It is now an object of the invention to provide a self-inking hand stamp of the initially defined type having a construction which is improved insofar as simple assembling of the components of the hand stamp is rendered possible, on the one hand, and also the use of comparatively inexpensive synthetic materials for producing the actuator yoke as well as the housing becomes possible, on the other hand, even if these inexpensive materials do not have the best properties in terms of an elastic deformation. Moreover, it is also sought to enable locking of the actuator yoke on the housing which is gentle on the material, wherein, moreover, in the lowermost locking position of the actuator yoke on the housing, a blockage shall be feasible to thereby provide for a secure locking in this position without the risk of an unintentional release of such locking, in contrast to the design according to the prior art, so that in this lower locked position in which the hand stamp has the smallest dimensions, the hand stamp can be accommodated in minimum-sized packages for transportation purposes.

To achieve the object set according to the invention, the invention provides a self-inking hand stamp. Advantageous embodiments and further developments are defined in the dependent claims.

In the self-inking hand stamp according to the invention, in particular two separate bearing members are provided for the—preferably pin-shaped—axle portions on the stamp plate, wherein these bearing members are inserted in associated seats in the lateral parts of the actuator yoke in axis-parallel manner and snapped in one or more snap-in position(s). For such a snapping engagement, relatively slight elastic deformations may be sufficient since, if the bearing members in their inserted position do not project beyond the contour of the leg parts or lateral parts of the actuator yoke, an unintentional detachment of a bearing member and its movement out of the actuator yoke is practically impossible; if a bearing member is to be intentionally removed from the actuator yoke, this can be effected only by means of a suitable tool. On the one hand, this allows for a simple assembly of the components of the hand stamp, it being possible to pre-mount the bearing members on the lateral parts of the actuator yoke—in one of the snapped-in positions—such that they do not project beyond the inner contours of the lateral parts of the actuator yoke. Subsequently, the stamp plate is arranged in the housing, wherein it protrudes, by means of its axle portions, through the slit-like openings in the side walls of the housing, and the actuator yoke is downwardly displaced over the housing, wherein the bearing members are brought into alignment with the axle portions of the stamp plate so that then they can be slipped onto these axle portions by axial inward pressing. As the material for the actuator yoke and the bearing members, an inexpensive ABS synthetic material or POM may be used, e.g.

For a snapping engagement of the bearing members in the lateral parts of the actuator yoke, it may be suitable for stability purposes if the, or each, bearing member, respectively, on at least one lateral wall thereof includes at least one lateral snap-in projection on its outer side as snap-in element for snapping-in behind a lateral projection on the boundary of the seat in the lateral part of the actuator yoke. Furthermore, for defining the pre-mounting position mentioned, as well as for defining the operating position for actuation of the hand stamp it is suitable if two lateral snap-in projections are located one behind the other in insertion direction. To obtain large, stable snap-in surfaces, it is furthermore advantageous if the, or each, lateral snap-in projection, respectively, is formed by a generally semi-cylindrical bead.

For achieving the different snap-in positions, primarily with a view to the aforementioned locking positions for the actuator yoke on the housing, it is also advantageous if the, or each, bearing member, respectively, includes an upper resilient snap-in tongue having an upper snap-in element. With a view to an easy snapping-in, ensuring as short snapping deflections as possible, it is furthermore suitable if the upper snap-in element on the resilient snap-in tongue is formed by a spherical-calotte-shaped projection, and in that in an upper delimiting wall of the seat in the actuator yoke lateral part, at least one partially spherical snap-in depression is provided which cooperates with the said projection. Here, with a view to the different snap-in positions, i.e. the operating position, on the one hand, and the locking position of the actuator yoke on the housing, on the other hand, it is advantageous if two partially spherical snap-in depressions are arranged in the upper seat-delimiting wall one behind the other in insertion direction.

The bearing members, due to their slide-like actuation when being used, can particularly advantageously be employed for locking the actuator yoke on the housing of the hand stamp, and accordingly, a particularly advantageous embodiment of the hand stamp according to the invention is designed such that the bearing member at the same time is designed as a locking element for locking the actuator yoke on the housing by engagement with the associated housing side wall. For a stable locking which, with regard to the displacement of the bearing members is easy to perform, it is advantageous if the, or each, bearing member, respectively, includes at least one locking projection, and the associated housing side wall includes at least one corresponding depression on its outer side, adjacent the slit-type opening. For reasons of symmetry, to prevent a possible canting of the movable parts relative to each other, it is also advantageous if the, or each, bearing member, respectively, includes two upper, web-like locking projections, and the housing side wall includes at least two depressions on either side of the slit-type opening. Moreover, by means of simple measures, the present, particularly preferred embodiment of the hand stamp can be designed for a trouble-free, automatic release of the locking engagement, and for this it is suitable if the, or each, locking projection, respectively, on its lower, inner rim has a chamfer provided as control surface for an outward-displacement of the bearing member during downward displacement of the actuator yoke relative to the housing. If in this embodiment the actuator yoke which is locked on the housing is pressed by a slight distance downwards from its locked position, contrary to the force of a common compression spring which presses the actuator yoke upwards, away from the housing, the control surfaces of the bearing members will slide over respective edges on the side walls of the housing so that the bearing members each are pressed outwards and are displaced and thereby again unlock the actuator yoke from the housing.

In order to allow for locking of the actuator yoke on the housing at various positions for fulfilling different functions, it is, furthermore, advantageous if several depressions are provided one above the other in the housing side wall.

As has already been mentioned, it would be suitable to be able to block the locking engagement of the actuator yoke on the housing in that position in which these two essential stamp components are pushed together to the greatest extent such that an unintentional release of the locking engagement is reliably prevented, whereby, further on, this locking position would become an advantageous transporting position for the hand stamp which then has its smallest dimensions. The bearing members provided according to the invention allow for such a blocking engagement in an advantageous manner, a blocking element being provided which, in its blocking position on the lower rim of the housing blocks the bearing member or the bearing members in its (their) inwardly displaced locking position. To prevent unintentional staining of the printing characters of the stamp plate, e.g. on the inner surfaces of the package, a cover may be used for the lower side of the stamp, or more precisely, for the lower side of the housing, and in a further development of the last mentioned embodiment of the hand stamp according to the invention, it is, therefore, particularly advantageous if the blocking element is formed by a cover which can be slipped onto the lower housing rim. For a simple design, it is suitable if in the blocked position, the cover, with a blocking projection thereof, abuts on a shoulder on the lower side of the bearing member. For obtaining a economical construction, it is here furthermore suitable if the blocking projection at the same time forms a snap-in projection which, in the slipped-on position of the cover, engages over a lower frame part of the housing.

In general, the present hand stamp is particularly characterized in that the bearing member on the actuator yoke includes an outer pre-mounting position, a middle operating position, as well as an inner locking position.

The invention will now be explained in more detail and by way of a preferred exemplary embodiment to which, however, it shall not be restricted, and with reference to the drawing. In detail, in the drawings,

BRIEF DESCRPTION OF THE DRAWING

DETAIL DESCRIPTION

Figure 1:
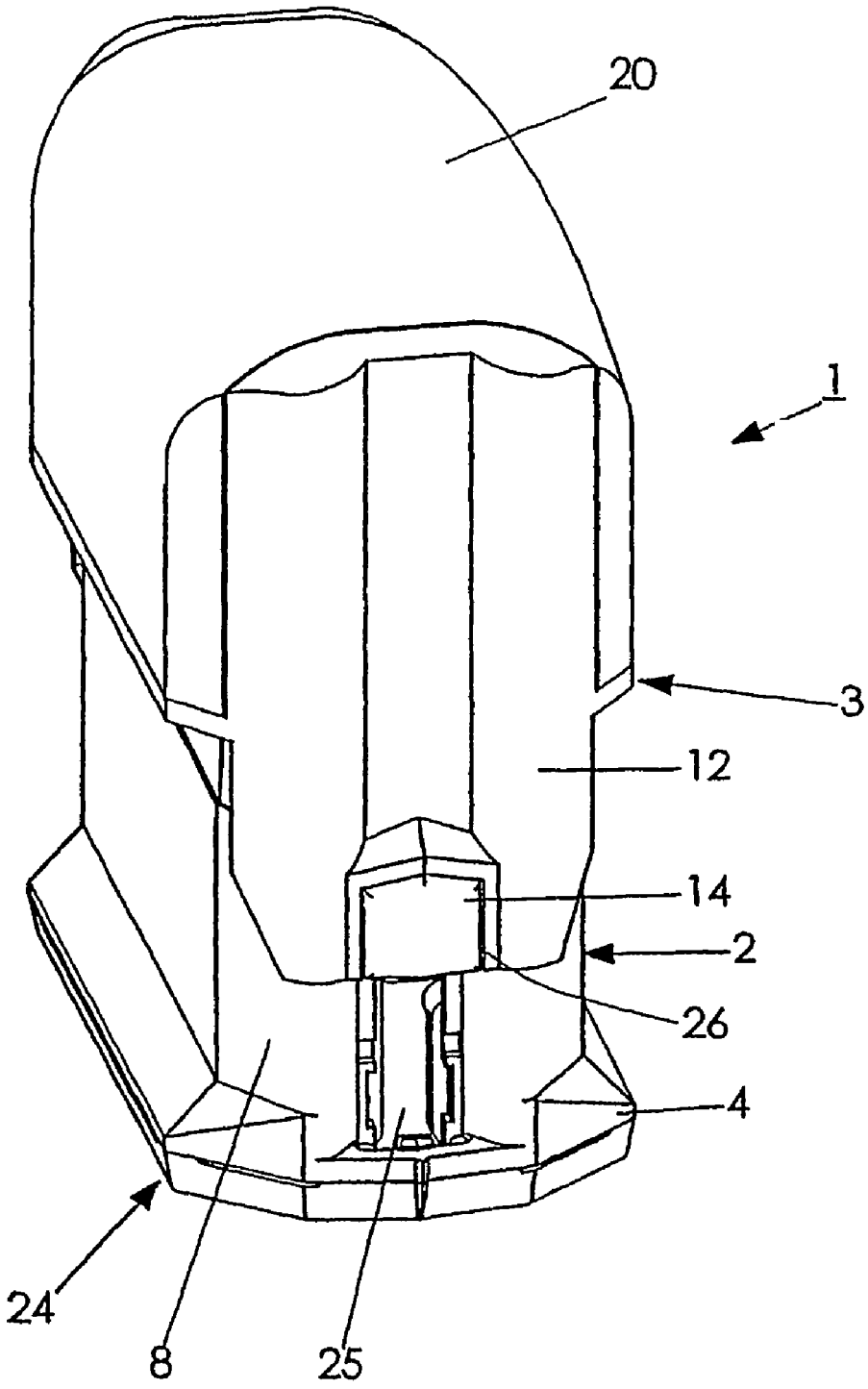
FIG. 1 shows a perspective view of a self-inking hand stamp according to the invention.
Figure 2:
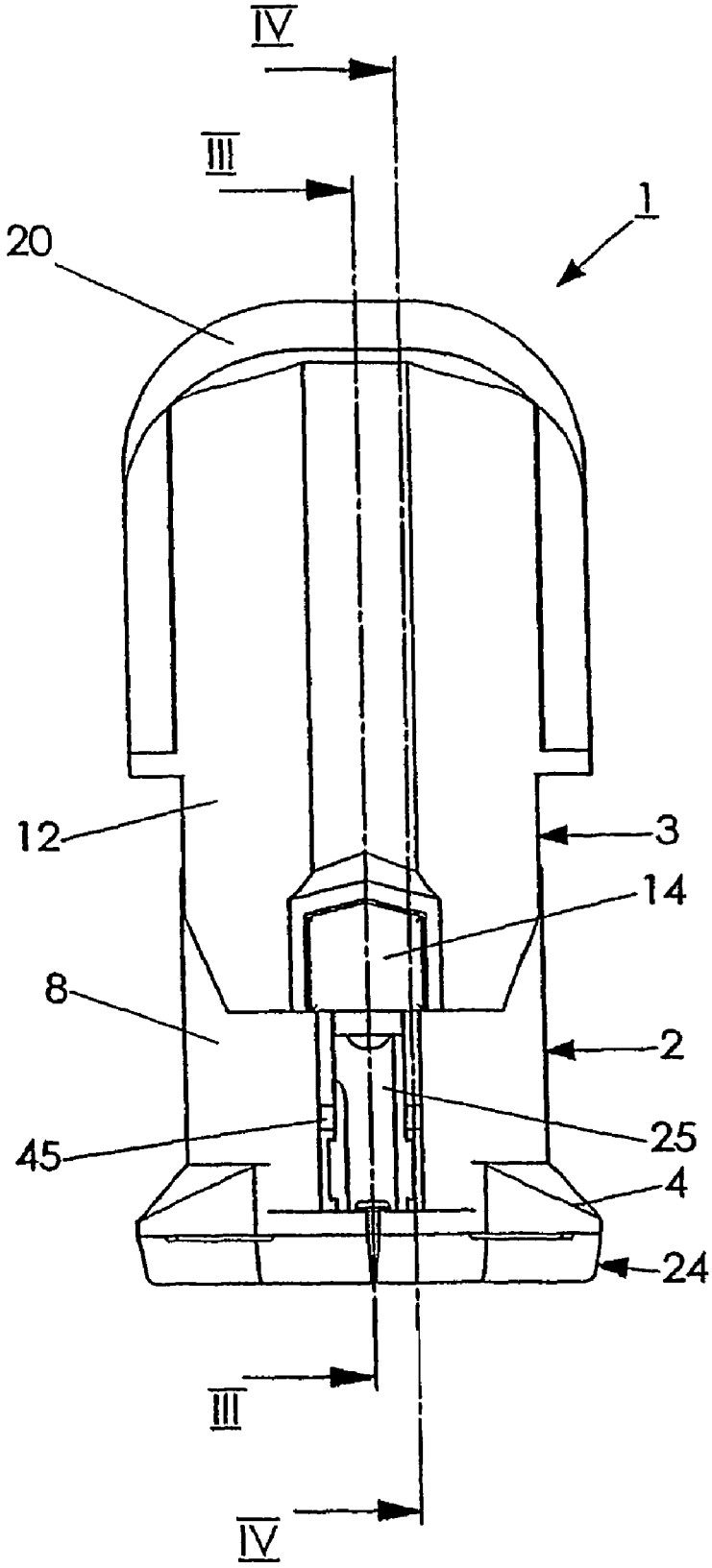
FIG. 2 shows a side view of this hand stamp.
Figure 3:
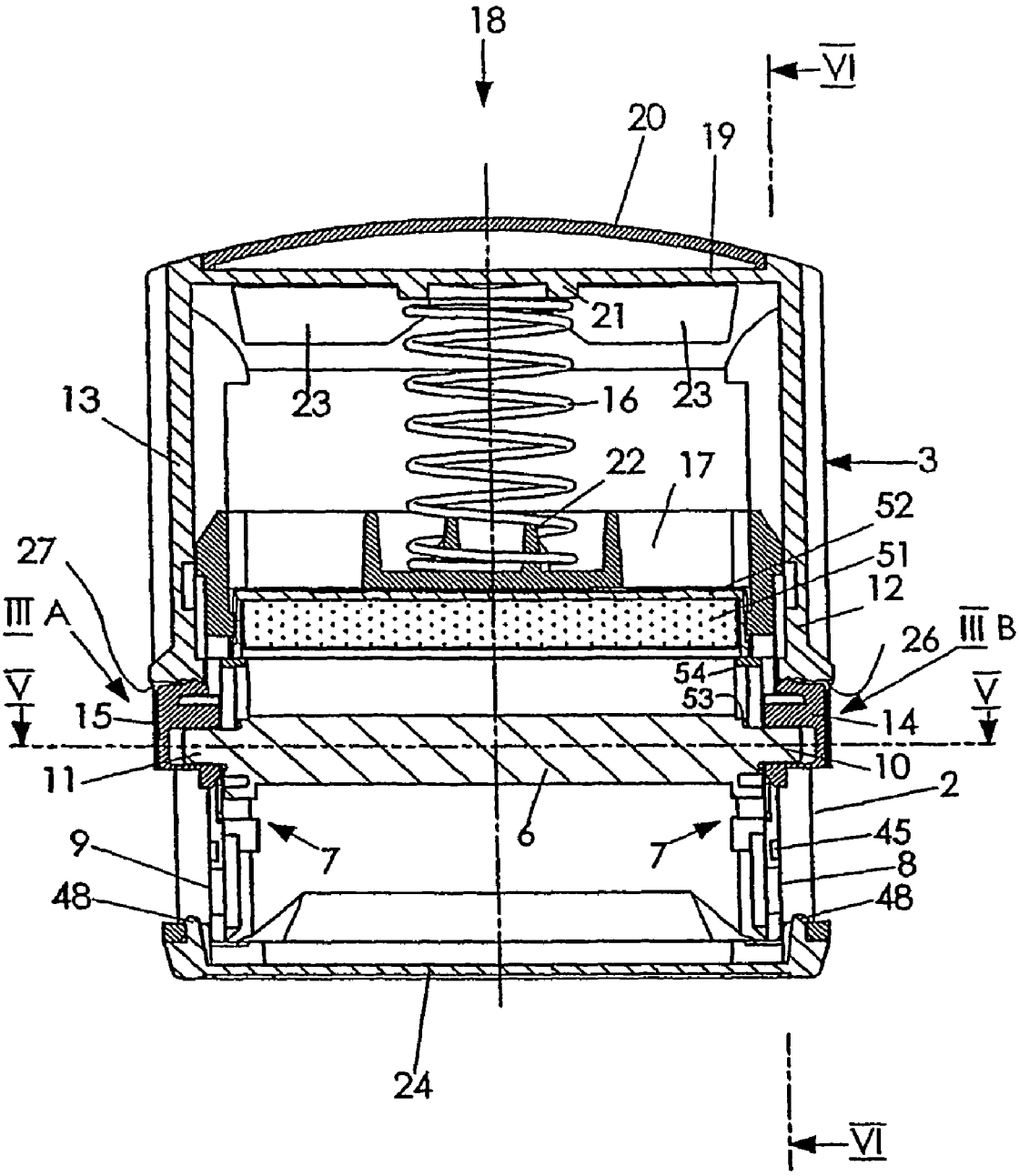
FIG. 3 shows a longitudinal section through this hand stamp according to line III-III of FIG. 2.
Figure 13:
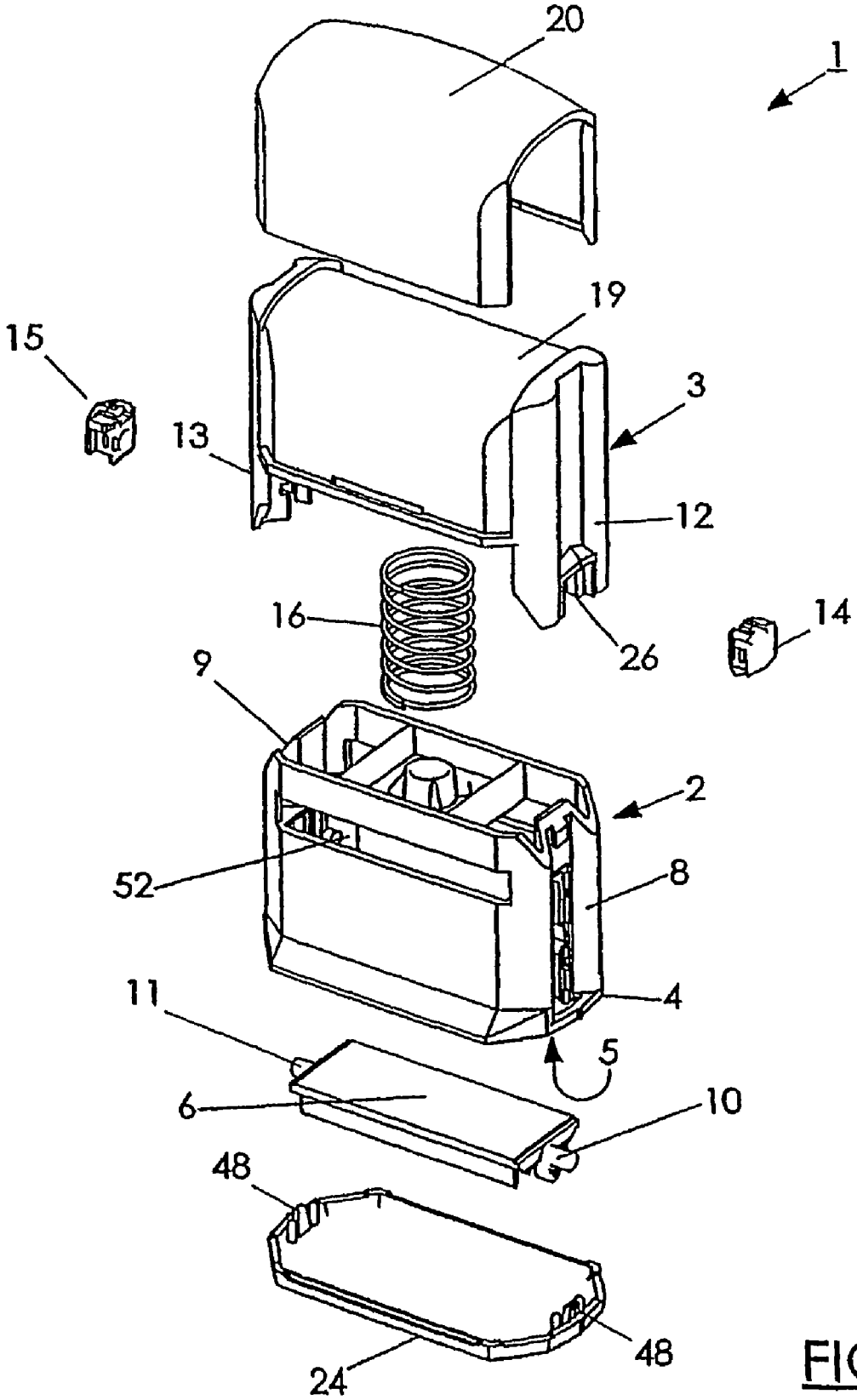
FIG. 13 shows the essential components of the present hand stamp in an exploded illustration, from which also the assembly of the components of the hand stamp is immediately visible.

The general set-up of the self-inking hand stamp 1 illustrated in the drawing can best be seen from FIGS. 1 to 3 and, as regards its essential components and their assembly, from FIG. 13. The self-inking hand stamp 1 shown, termed hand stamp 1 in short hereinafter, in a per se conventional manner has a housing 2 onto which an actuator yoke 3 is put so as to be vertically displaceable relative to the former (when the housing 2 rests on a horizontal substrate). When setting the hand stamp 1 on a substrate to be stamped, the housing 2 has a lower housing frame 4 which has a lower passage opening 5 (cf. FIG. 3) for the characters not further illustrated in the drawing on a stamp plate 6. This stamp plate or text plate 6 has an associated common turning (inverting) mechanism which, in its entirety, is merely schematically illustrated at 7 in FIG. 3, and comprises control cams on the inner side of the side walls 8, 9 of the housing 2, and on the two mutually oppositely arranged short front sides of the stamp plate 6, respectively, these control surfaces or cams causing pivoting of the stamp plate 6 about its front-side projecting pin-shaped axle portions 10, 11 integrally molded therewith, or more precisely, by 180° about their geometric axis, when displacing the stamp plate 6 downwards by means of the actuator yoke 3, cf. in this respect e.g. also the initially mentioned U.S. Pat. No. 5,152,223 A. For mounting the axle portions 10, 11, bearing members 14, 15 are provided on the actuator yoke 3 or, more precisely, on the lateral parts or legs 12, 13 thereof, respectively, which will be explained in more detail with regard to their design and function.

The actuator yoke 3 also is supported in conventional manner on the housing upper side 17 via a helical compression spring 16, cf. particularly FIG. 3, and when using the hand stamp 1, the actuator yoke is pressed downwards relative to the housing 2, against the force of this spring 16, according to the direction of arrow 18 in FIG. 3. At its upper web portion which extends transversely and connects the two lateral parts 12, 13, the actuator yoke, moreover, has a depression 19 which, e.g., extends from the front side of the hand stamp 1 over the upper side towards the rear side, it being possible to slip an arched inspection window part 20 over this depression 19, cf. in particular also FIG. 13. In this depression 19, an information sheet showing the stamp imprint and containing further information can be inserted (not illustrated), this information sheet being visible through the inspection window part 20 which is transparent. The helical compression spring 16 is held on projections 21, and 22, respectively, of the housing 2, and of the actuator yoke 3, respectively, in a manner known per se and thus it is ensured against lateral slipping, cf. in particular FIG. 3, wherein also upper ribs 23 laterally clamping the spring 16 are visible.

Furthermore, a lower cover 24 covering the housing lower side is provided for the present hand stamp 1, which lower cover is particularly visible in FIG. 13 in addition to FIGS. 1 to 3, FIG. 4 and FIG. 7. In order that the axle portions 10, 11 of the stamp plate 6 can be accommodated in the bearing members 14, 15, they must extend from the inner side of the side walls 8, 9 of the housing 2 to the outer side thereof, and to this end, slit-type openings 25 particularly visible from FIGS. 1 and 2 are provided in the side walls 8, 9 of the housing-2. Adjacent these slit-type openings 25, the said control surfaces or control cams of the turning mechanism 7 for the stamp plate 6 are present on the inner side of the side walls 8, 9.

Figure 8A:
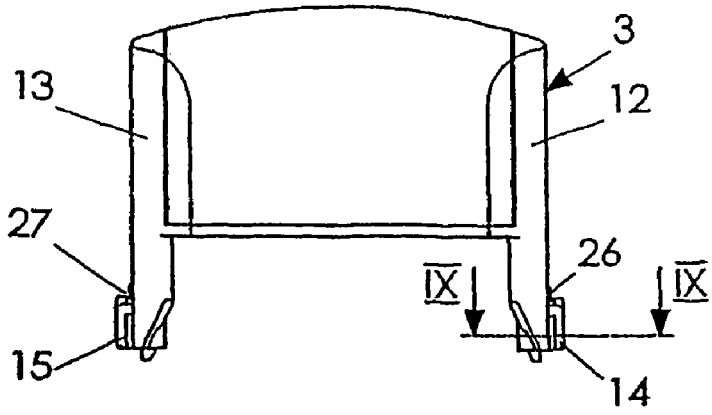
FIGS. 8A and 8B show a front view, and a side view, respectively, of the actuator yoke of the present hand stamp, including bearing members inserted therein.
Figure 8B:
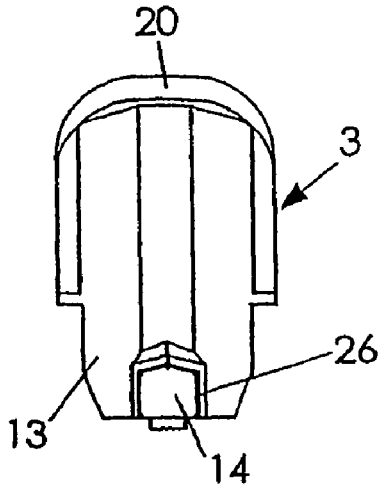
Figure 9:
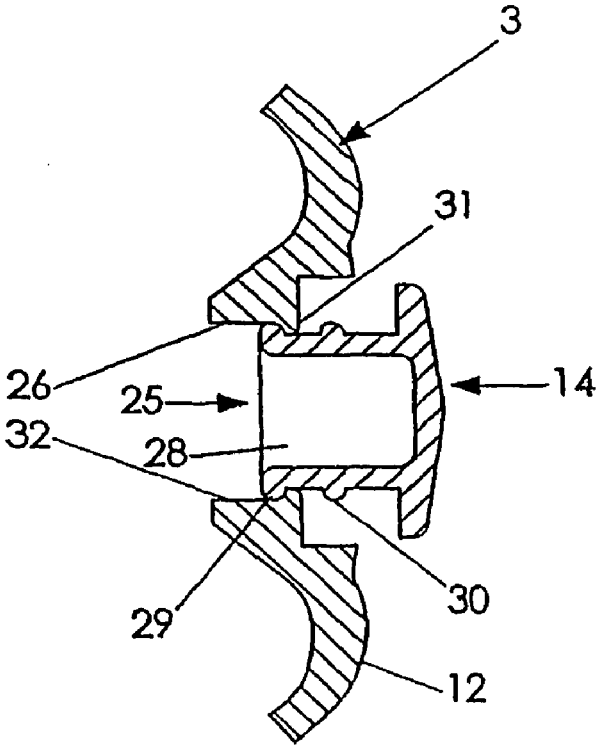
FIG. 9 shows a cross-sectional representation through a lateral part or leg of this actuator yoke, according to line IX-IX of FIG. 8A.

The bearing members 14, 15 are inserted in associated seats 26, 27 in the lateral parts 12, 13 of the actuator yoke 3. During its assembly, considering the normal, upright operating position of the hand stamp 1, the bearing members 14, 15 are horizontally inserted in their seats 26, 27, according to the axial direction of the axle portions 10, 11 of the stamp plate 6, wherein, during said assembly of the hand stamp 1, at first they are inserted in a pre-mounting position visible from FIGS. 8A, 8B as well as FIG. 9—in cross-section—with regard to the one bearing member 14. From FIG. 9 it can be seen that the bearing member 14 (and, likewise, the bearing member 15; to simplify matters, the following description is mostly restricted to the one bearing member, i.e. bearing member 14, yet this applies accordingly also for the other bearing member 15) has a cylindrical, blind-hole-type bearing recess 28 for the respective associated pin-shaped axle portion, e.g. 10 (cf. also FIG. 3B), or 11, cf. FIG. 3A. In the pre-mounting position according to FIG. 9, however, the bearing members, e.g. 14, are still located sufficiently outwardly so that when the actuator yoke 3 including the bearing members 14, 15 is set onto the housing 2, the stamp plate 6 can then still be inserted into the housing 2 from below, without its axle portions 10, 11 being blocked by the bearing members 14, 15. Then, as soon as these axle portions 10, 11 are provided in a position in axial alignment with the bearing recesses 28 of the bearing members 14, 15, these bearing members 14, 15 are pressed inwards so that they reach a position according to FIG. 3B—the normal operating position. In this position, the actuator yoke 3 can still be displaced vertically downwards (or upwards) relative to the housing 2. However, if the bearing members 14, 15 are forced still further inwards, cf. FIG. 3 and FIG. 3A, they reach a position in which they lock the actuator yoke 3 on the housing 2, as will be explained in more detail hereinafter by way of FIGS. 4 and 4A.

Figure 5:
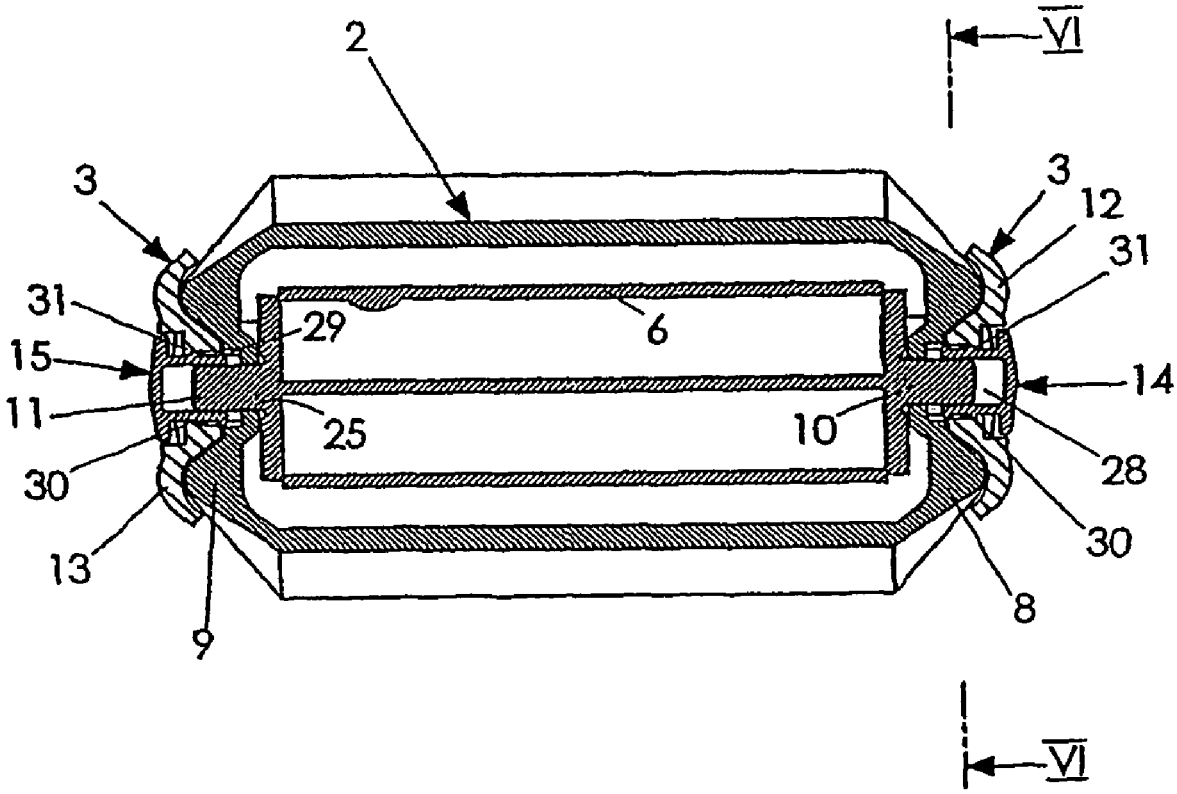
FIG. 5 shows a cross-section according to line V-V of FIG. 3.

To enable all three different positions of the bearing members 14, 15 on the actuator yoke 3, different snap-in elements are provided. Thus, in particular in FIG. 9 as well as, furthermore, in FIGS. 10, 11 and 12, lateral snap-in elements having the shape of semi-cylindrical snap-in projections 29, 30 in the form of beads are visible, in each case two mutually parallel lateral snap-in projections 29, 30 being provided in successive arrangement in insertion direction, these snap-in projections 29, 30 snapping in behind lateral projections 31 provided on lateral delimiting means 32 of the slit-type openings 25 in the lateral parts 12, 13 of the actuator yoke 3. If according to FIG. 9, the bearing member 14 is displaced horizontally inwards from the pre-mounting position shown, i.e. towards the left according to the illustration, the bearing member 14 will get from the snap-in projection shown, in which the snap-in projections 29 are snapped in behind the projections 31, into the normal operating position, in which the semi-cylindrical bead snap-in projections 30 located further to the right in FIG. 9, engage behind the projections 31. This position is also shown in FIG. 5. The semi-cylindrical, bead-shaped snap-in projections 29, 30 are provided on side walls 33 of a generally block-shaped body of the bearing member 14, or 15, respectively, cf. in particular FIG. 10. To the upper side of the respective bearing member 14, or 15, respectively, a snap-in tongue 34 is molded; which on its upper side has an upper snap-in element 35 in the form of a spherical-calotte-shaped projection. Below this snap-in tongue 34, the respective bearing member 14, or 15, respectively, has a clearance recess 36 for the snap-in tongue 34, cf. in particular FIG. 10.

Figure 3A:
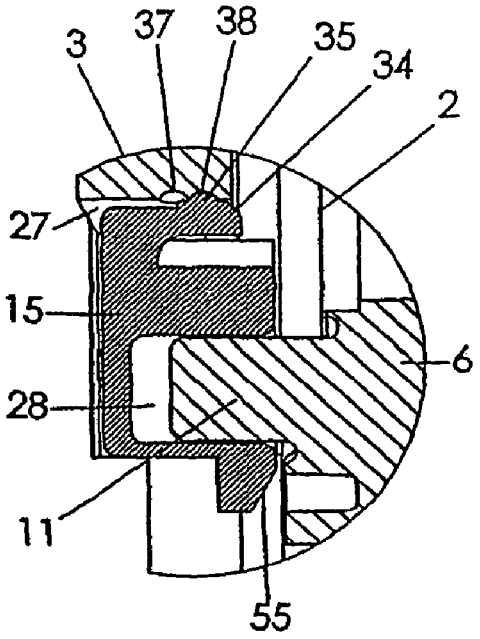
FIGS. 3A and 3B show details IIIA and IIIB of this sectional representation on a scale enlarged relative to that of FIG. 3.
Figure 3B:
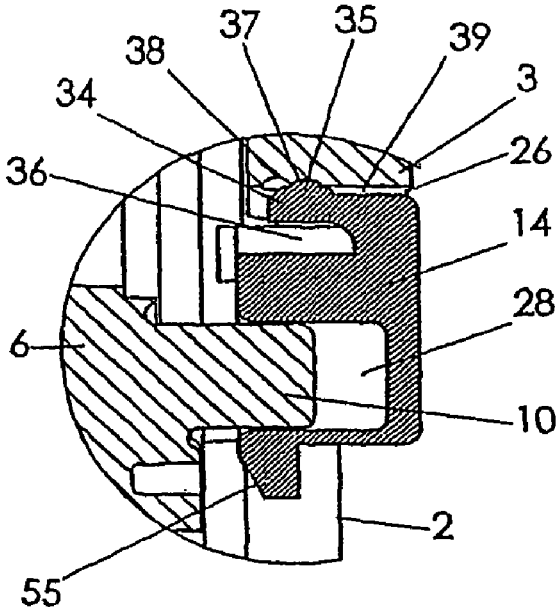
Figure 6:
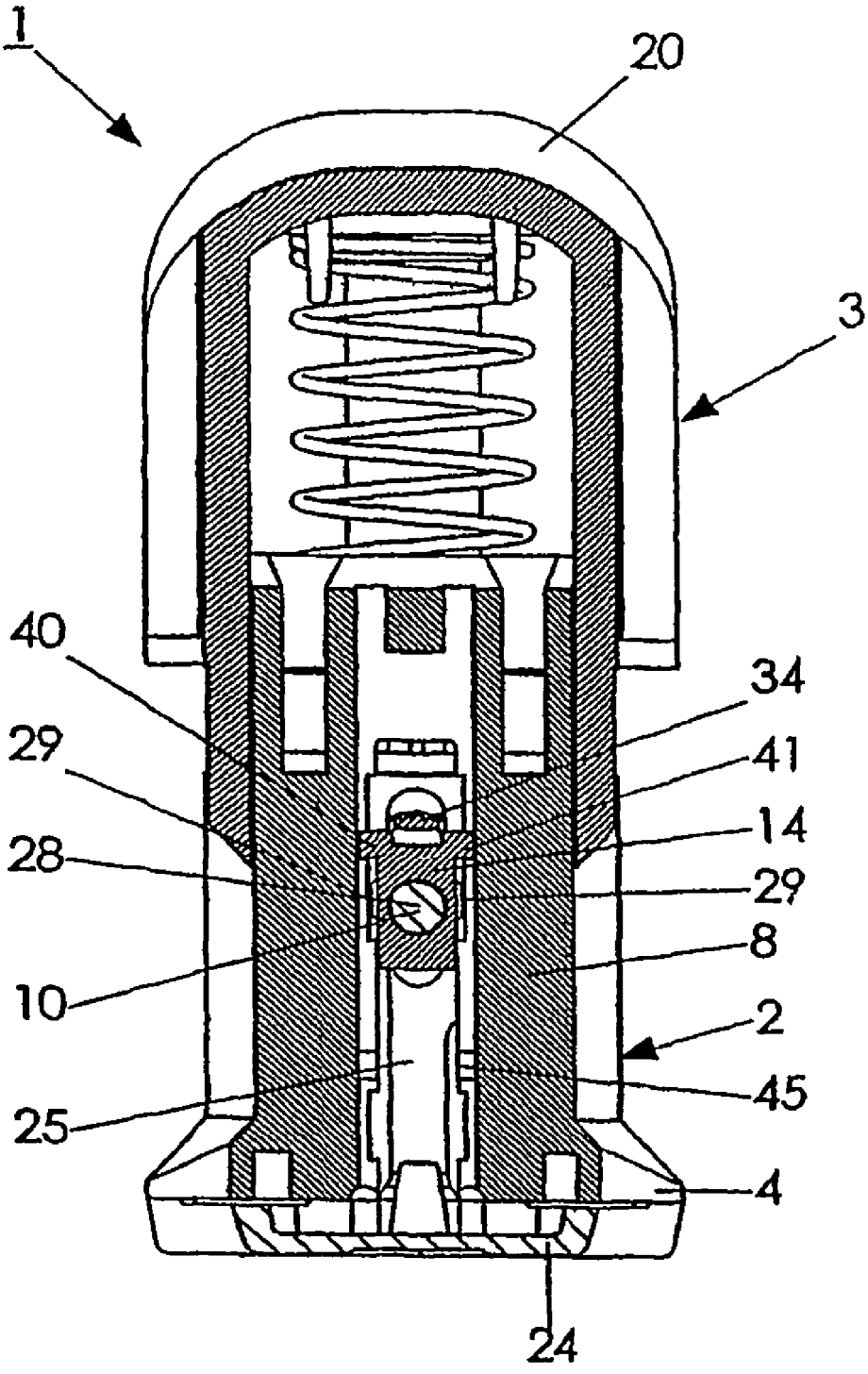
FIG. 6 shows a longitudinal section according to line VI-VI of FIG. 3, and of FIG. 5, respectively.
Figure 7:
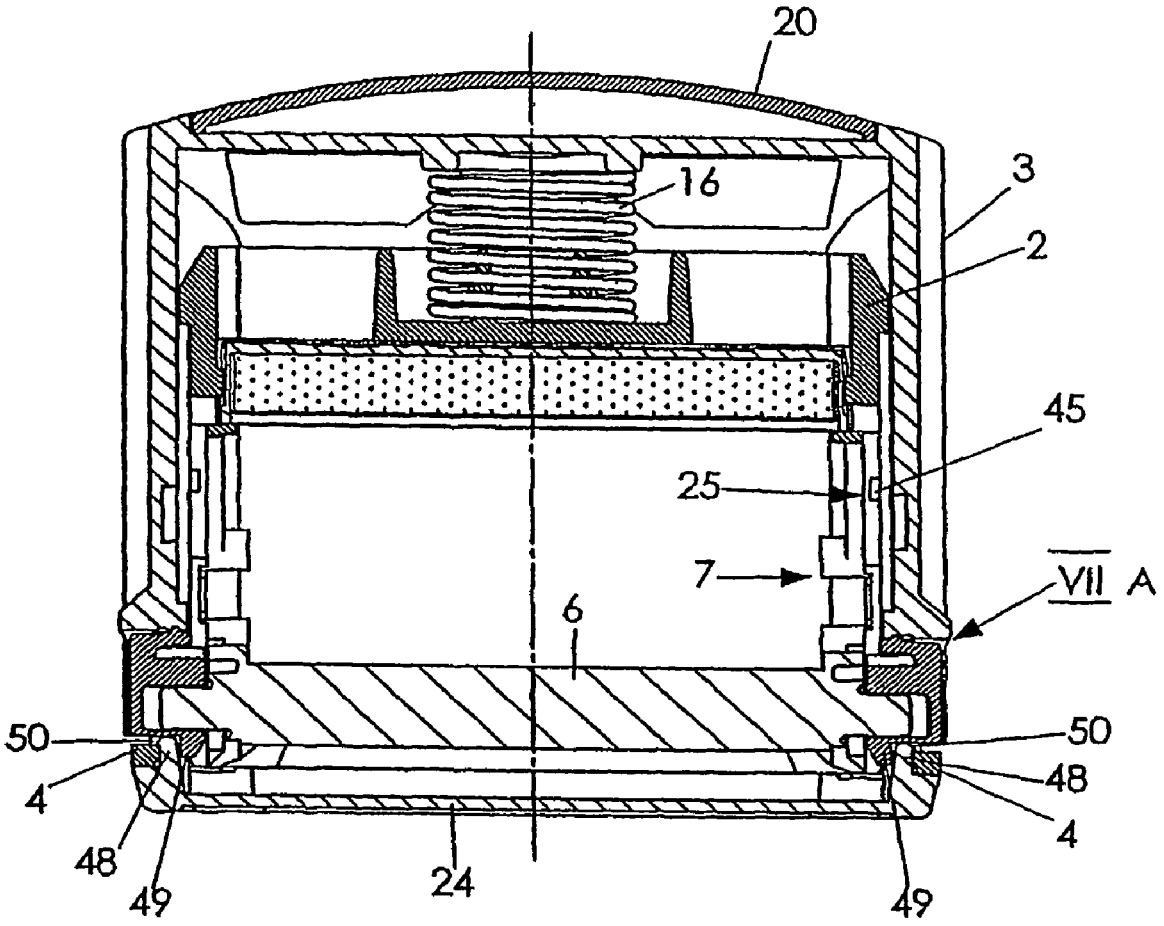
FIG. 7 shows a sectional representation of the hand stamp similar to that of FIG. 3, yet in a position of the hand stamp in which the actuator yoke assumes its transporting position in which it is completely pressed onto the housing, whereas in FIG. 3 the position for changing the ink pad is shown.
Figure 7A:
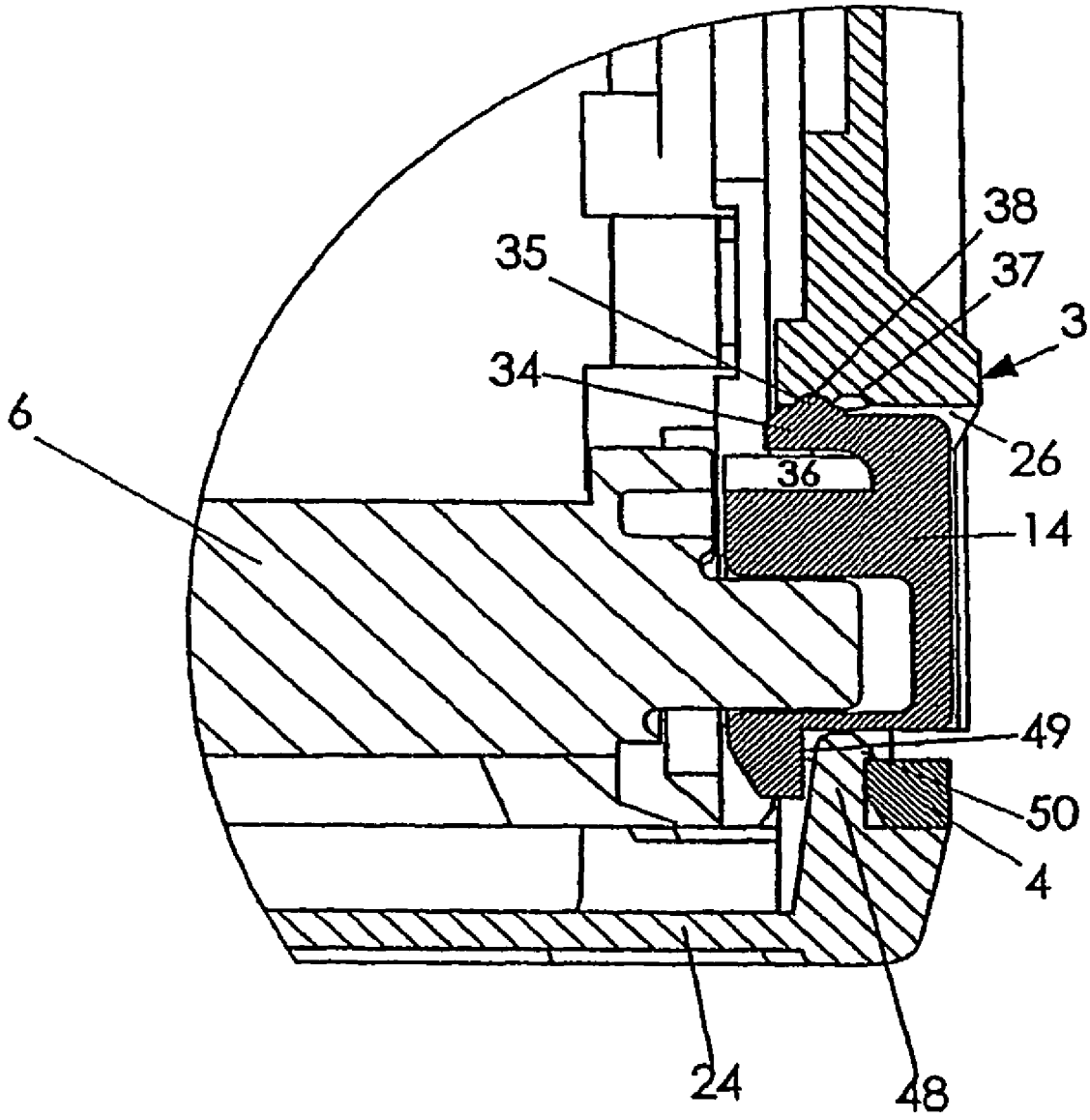
FIG. 7A shows a detail VIIA of FIG. 7 on a scale enlarged relative to the former.

The snap-in tongue 34 with the snap-in element 35 is particularly visible also in FIGS. 3, 3A and 3B as well as in FIGS. 7 and 7A, yet also in FIG. 6, in cooperation with associated partially spherical snap-in depressions 37, 38 in an upper delimiting wall 39 of the seat 26, or 27, respectively. In FIGS. 3 and 3A, the bearing members 14, 15 are illustrated each pressed completely inwards, wherein the upper spherical-calotte-shaped snap-in element 35 is snapped-in in the further inwardly located snap-in depression 38. In this most inwardly located position, the inner locking position, each bearing member 14, 15 simultaneously constitutes a locking element so as to lock the actuator yoke 3 on the housing 2. In FIG. 3B, however, the—middle-operating position is shown in which the upper calotte-shaped snap-in element 35 is snapped into the farther outwardly arranged spherical snap-in depression 37.

The locking position according to FIG. 3A or FIG. 3 is also illustrated in FIGS. 7 and 7A, yet here for a lower position of the actuator yoke 3 on the housing 2, which lower locking position at the same time is a transporting position for the hand stamp 1, since in this position, the hand stamp 1 has the smallest outer dimensions (height dimensions), as will be seen directly from a comparison of FIG. 7 with FIG. 3.

Figure 4B:
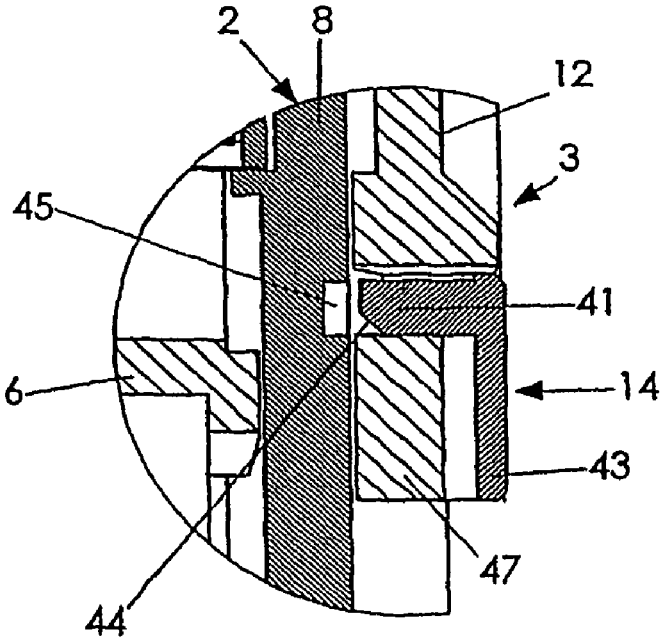
FIG. 4B shows a sectional representation of a detail corresponding to FIG. 4A, yet with a position of the bearing member of the hand stamp that has changed as compared to that of FIG. 4A.
Figure 4:
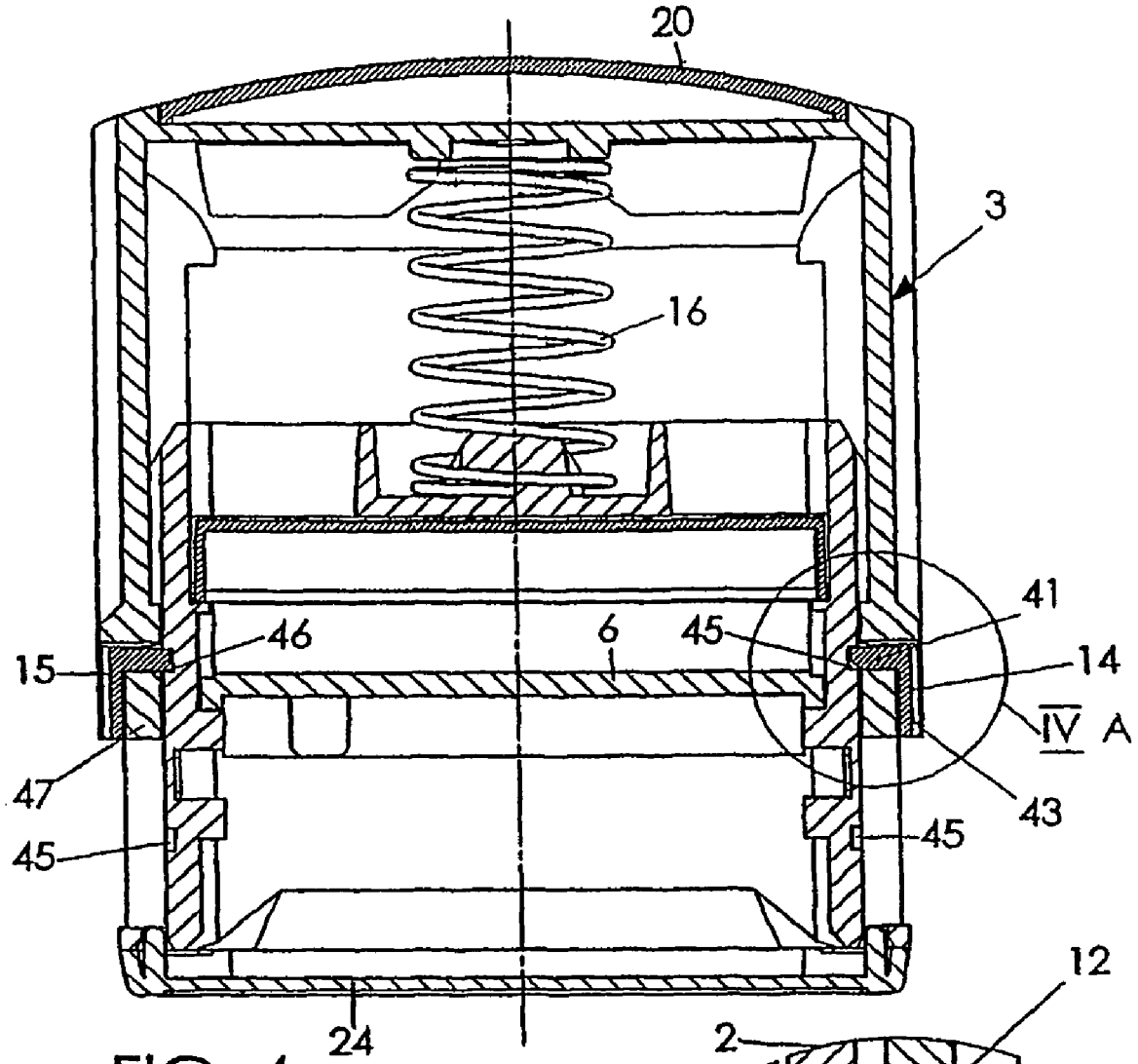
FIG. 4 shows a further longitudinal sectional representation according to line IV-IV of FIG. 2, the sectional plane extending in parallel to the sectional plane according to FIG. 3.
Figure 4A:
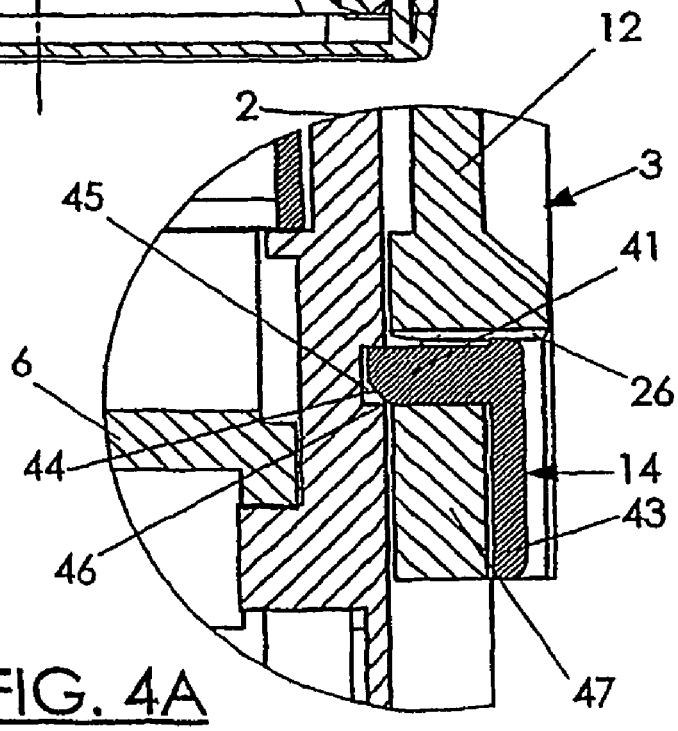
FIG. 4A shows the detail IVA of FIG. 4 on a scale enlarged relative to the former.
Figure 10:
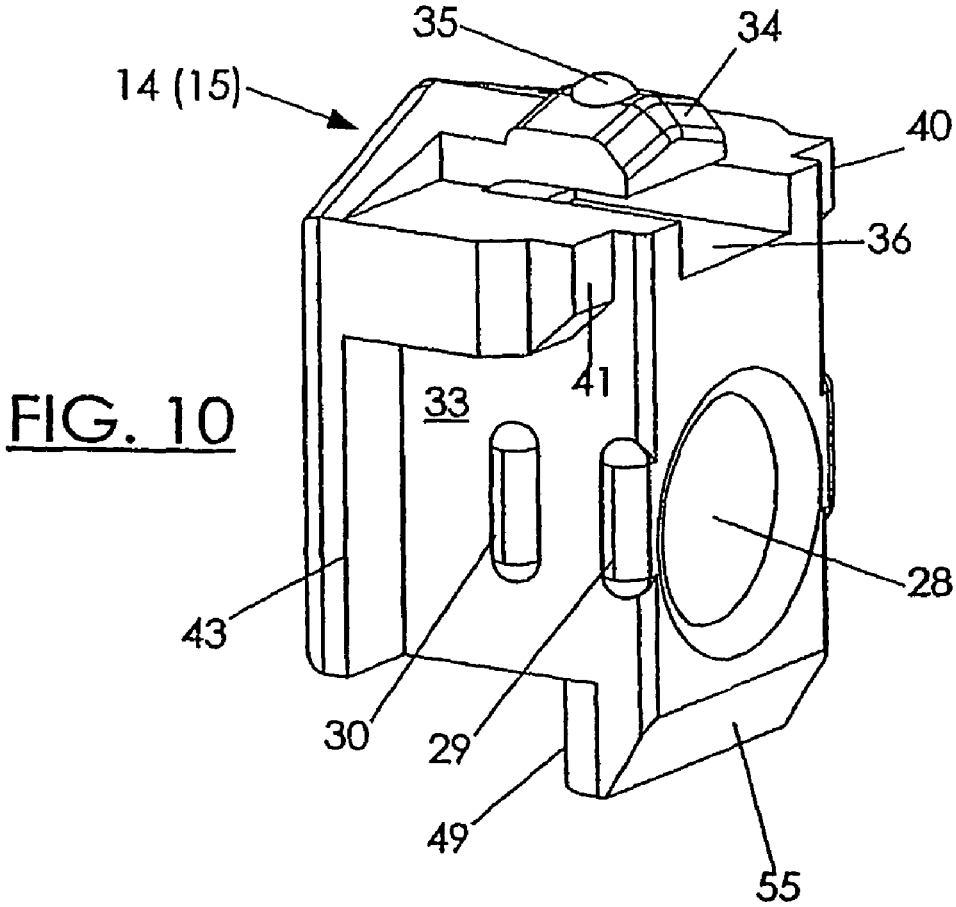
FIG. 10 shows a perspective view of a bearing member.
Figure 11:
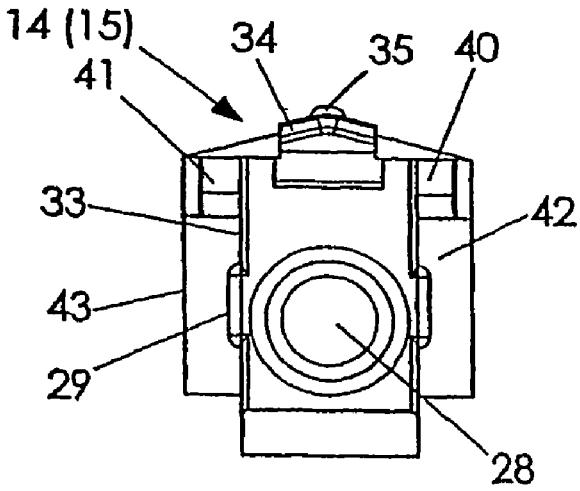
FIGS. 11 and 12 show a view of an inner side of the bearing member, and a side view of this bearing member, respectively.
Figure 12:
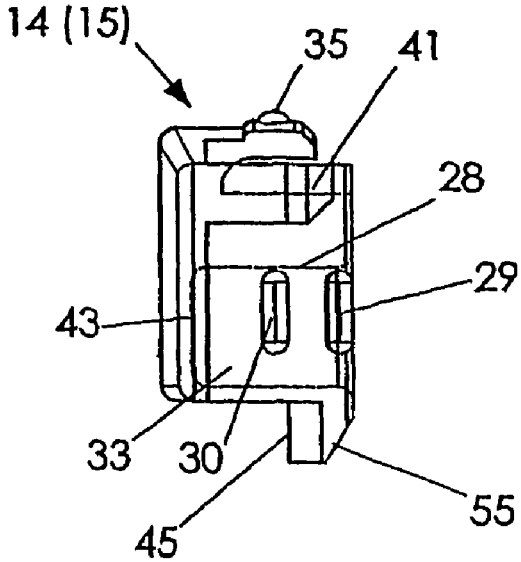

The mode of locking the actuator yoke 3 with the housing 2 can best be seen in detail from FIGS. 4, 4A and 4B as well as from FIG. 6, the means required for this being visible on the bearing members 14 and 15, respectively, and also from FIGS. 10, 11 and 12. In detail, each bearing member, e.g. bearing member 14, carries web-like locking projections 40, 41 on its upper side on either side of its block-shaped main body, which locking projections give the bearing member 14, and 15, respectively, viewed from the inner side (cf. also FIG. 11) an approximately T-shaped appearance, not considering the rear back-stop parts 42, 43 which extend at right angles to the web-like locking projections 40, 41. The locking projections, e.g. 41 according to FIG. 4A or 4B, have a chamfer 44 at their lower inner rim, which chamfer acts as a wedge face, ramp or control surface, the function of which will be described in more detail hereinafter.

In the locking position according to FIG. 4 and FIG. 4A, the locking projections 40, 41 project into corresponding depressions 45 which are rectangular in an elevation view, and which are externally arranged on either side of the slit-type opening 25 in the side wall 8, and 9, respectively, of the housing 2; in particular, always two such depressions 45 are provided, one above the other. For instance, in FIGS. 1 and 2, the lower pair of depressions 45 for locking the actuator yoke 3 on the housing 2 in the lower, transporting position (cf. FIG. 7) can be seen. The upper depressions 45 provided for locking in the position according to FIGS. 3 and 4 can be seen from FIGS. 4, 4A and 4B as well as FIG. 7. In the locking position, e.g. according to FIGS. 4, 4A, a lower shoulder of the depression 45 with an outer edge 46 is located opposite the chamfer 44. If the locking mechanism is to be rendered inactive, the actuator yoke 3 is somewhat pressed downwards in the position illustrated relative to the housing, 2 the chamfer 44 sliding over edge 46, whereby the bearing member 14 (or 15, respectively) is displaced towards the outer side, i.e. towards the right according to the illustration in FIG. 4A, until having reached the position according to FIG. 4B, in which the locking projection 41 (or 40) can be moved past the housing side wall 8 (or 9, respectively).

However, this outward-displacement from the inner locking position into the middle, operating position is not possible if, as can be seen from FIGS. 7 and 7A, the lower cover 24, as blocking element, by means of the blocking projections 48 blocks the bearing members 14, 15 in the lower blocking position of the actuator yoke 3 on the housing 2. In doing so, the respective blocking projection 48 comes into engagement with a shoulder 49 on the lower side of the respective bearing member 14, or 15, respectively, and on the other side, the blocking projection 48 snaps in, with a snap-in nose serving as snap-in projection 50, over a lower frame part, more precisely over the lower housing frame 4 of the housing 2, cf. in particular FIGS. 7 and 7A.

From FIGS. 4 and 4A, moreover, it can be seen that the bearing members 14, 15, by means of their back-stop parts, e.g. 43, come to abut on a wall portion 47 of the lateral part or leg 12, or 13, respectively, of the actuator-yoke 3, if the bearing member 14, or 15, respectively, has been pressed completely inwards, i.e. into its locking position. By this abutment on the wall portions 47, the bearing members 14, 15 are prevented from being pressed inwards too much. These wall portions 47 result from the fact that the seats 26, 27 in the lateral parts 12, 13 of the actuator yoke 3, in an elevation view, have a section shape corresponding to the T-shape of the bearing members 14, 15 (not considering the back-stop parts 42, 43).

As such, however, it would also be very well possible to omit the back-stop parts 42, 43 of the bearing members 14, 15.

Finally, the common stamp pad or ink pad 51, which is merely schematically shown in the drawing, e.g. in FIG. 3, and which is inserted in the insertion compartment 52, is yet another component of the hand stamp 1. In the upper locking position of the actuator yoke 3 on the housing 2, as shown in FIG. 3, the ink pad 51 can be removed from its insertion compartment 52 or inserted into said insertion compartment 52, e.g. for an ink pad 51 exchange. From the upper locking position on the housing 2, illustrated in FIGS. 3 and 4, or from the lower locking position illustrated in FIG. 7, the actuator yoke 3, as has been mentioned, can be freed by pressing it shortly downwards so that the bearing members 14 will be pressed outwards, whereupon, when releasing the actuator yoke 3, the latter will be pressed upwards by the force of the spring 16; the stamp plate 6 with the stamp characters not further illustrated in the drawings is then pressed against the downward-facing free surface of the ink pad 51, i.e. the stamp plate 6 will then be positioned in its upper inking position. By abutting with its rim 53 on the lower insertion compartment ledges 54, the stamp plate 6 in this position also delimits the upward movement of the actuator yoke 3 relative to the housing 2.

In particular from FIGS. 3A and 3B as well as also from FIG. 7A and FIG. 10, it can finally be seen that the projection forming the shoulder 49 on the lower side of the bearing members 14, 15 at its inner side may be formed with a chamfer 55. This chamfer 55 facilitates mounting of the stamp plate 6 by inserting the axle portions 10, 11 in the bearing recesses 28 of the bearing members 14, 15, when the stamp plate 6 and the actuator yoke 3 are moved vertically relative to each other, the ends of the axle portions 10, 11 sliding over the chamfer 55 and displacing the bearing members 14, 15—if they were located too far inwardly—to an appropriate extend outwards until the axle portions 10, 11 will be located opposite the bearing recesses 28; subsequently, the bearing members 14, 15 can be displaced inwards again.

Although above a particularly advantageous embodiment of the self-inking hand stamp 1 according to the invention has been explained, changes and modifications are, of course, possible, such as, e.g., that only one bearing member is provided on only one leg of the actuator yoke 3, or that the lateral, bead-shaped snap-in projections 29, 30 are molded to only one side face 33 of the bearing member 14, or 15, respectively. In principle, these lateral snap-in projections 29, 30 can also be omitted, or the upper snap-in element 35, or the snap-in tongue 34, respectively, may be omitted if the lateral snap-in projections are provided such that they will (also) define the inner locking position of the bearing members 14, 15. For this, optionally, also three lateral snap-in projections each may be provided.

The invention claimed is:

1. A self-inking hand stamp (1) comprising a housing (2), an actuator yoke (3) displaceable relative thereto, in which a stamp character part is mounted by means of axle portions (10, 11) that project through slit-type openings (25) in the side walls (8, 9) of the housing (2), at least one of the axle portions being retained in a seat (26, 27) in one of the lateral parts (12, 13) of the actuator yoke (3) by means of a separate securing element, said securing element being insertable in the seat (26, 27) in axis-parallel manner and snappable therein, the securing element including at least one snap-in element (29, 30; 35) which cooperates with a corresponding snap-in element (31; 37, 38) on the lateral part (12, 13) of the actuator yoke (3), and with a turning mechanism (7) for the stamp plate (6) so as to move the latter during a displacing movement of the actuator yoke (3) relative to the housing (2) from an upper inking position in contact on an ink pad (51) into a lower stamping position, wherein the securing element is formed by at least one bearing member (14, 15) provided with a cylindrical bearing recess (28) for the axle portion (10, 11) of a stamp plate (6) provided as stamp character part, which bearing member (14, 15), in axial direction, has several snap-in positions in the lateral part (12, 13) of the actuator yoke (3).

2. A self-inking hand stamp according to claim 1, wherein the, or each, respectively, bearing member (14, 15) on at least one lateral wall (33) thereof includes at least one lateral snap-in projection (29, 30) on its outer side as snap-in element for snapping-in behind a lateral projection (31) on the boundary (32) of the seat (26, 27) in the lateral part (12, 13) of the actuator yoke (3).

3. A self-inking hand stamp according to claim 2, wherein the, or each, respectively, bearing member (14, 15) has two lateral snap-in projections (29, 30) located one behind the other in insertion direction.

4. A self-inking hand stamp according to claim 2, wherein the, or each, respectively, lateral snap-in projection (29, 30) is formed by a generally semi-cylindrical bead.

5. A self-inking hand stamp according to claim 1, wherein the, or each, respectively, bearing member (14, 15) includes an upper resilient snap-in tongue (34) having an upper snap-in element (35).

6. A self-inking hand stamp according to claim 5, wherein the upper snap-in element (35) on the resilient snap-in tongue is formed by a spherical-calotte-shaped projection, and in that in an upper delimiting wall (39) of the seat (26, 27) in the actuator yoke lateral part (12, 13), at least one partially spherical snap-in depression (37, 38) is arranged which cooperates with the said projection.

7. A self-inking hand stamp according to claim 6, wherein two partially spherical snap-in depressions (37, 38) are arranged in the upper seat-delimiting wall (39) one behind the other in insertion direction.

8. A self-inking hand stamp according to claim 1, wherein the bearing member (14, 15) is designed as a locking element, too, for locking the actuator yoke (3) on the housing (2) by engagement with the associated housing side wall (8, 9).

9. A self-inking hand stamp according to claim 8, wherein the, or each, respectively, bearing member (14, 15) includes at least one locking projection (40, 41) and the associated housing side wall (8, 9) includes at least one corresponding depression (45) on its outer side, adjacent the slit-type opening (25).

10. A self-inking hand stamp according to claim 9, wherein the, or each, respectively, bearing member (14, 15) includes two upper, web-like locking projections (40, 41), and the housing side wall (8, 9) includes at least two depressions (45) on either side of the slit-type opening (25).

11. A self-inking hand stamp according to claim 9, wherein the, or each, respectively, locking projection (40, 41) on its lower, inner rim has a chamfer (44) provided as control surface for an outward-displacement of the bearing member (14, 15) during downward displacement of the actuator yoke (3) relative to the housing (2).

12. A self-inking hand stamp according to claim 9, wherein several depressions (45) are provided one above the other in the associated housing side wall (8, 9) so as to define several locking positions for the actuator yoke (3) on the housing (2).

13. A self-inking hand stamp according to claim 8, comprising a blocking element which, in its blocking position on the lower rim of the housing (2), blocks the bearing member (14, 15) in its inwardly displaced locking position.

14. A self-inking hand stamp according to claim 13, wherein the blocking element is formed by a cover (24) which can be slipped onto the lower housing rim.

15. A self-inking hand stamp according to claim 14, wherein in the blocked position, the cover (24), with a blocking projection (48) thereof, abuts on a shoulder (49) on the lower side of the bearing member (14, 15).

16. A self-inking hand stamp according to claim 15, wherein the blocking projection (48) at the same time forms a snap-in projection (50) which, in the slipped-on position of the cover, engages over a lower frame part (4) of the housing (2).

17. A self-inking hand stamp according to claim 1, wherein the bearing member (14, 15) on the actuator yoke (3) has an outer pre-mounting position, a middle operating position, as well as an inner locking position.

* * * * *